US006283790B1

(12) United States Patent
Idehara et al.

(10) Patent No.: US 6,283,790 B1
(45) Date of Patent: Sep. 4, 2001

(54) L-SHAPED CONNECTOR FOR CONNECTING ANTENNA WIRE

(75) Inventors: Tsuru Idehara; Kunihiro Yaghu, both of Tokyo (JP)

(73) Assignee: Suntec & Co., Ltd., Tokyo (JP)

( * ) Notice: Subject to any disclaimer, the term of this patent is extended or adjusted under 35 U.S.C. 154(b) by 0 days.

(21) Appl. No.: 09/527,219

(22) Filed: Mar. 16, 2000

(30) Foreign Application Priority Data

Mar. 16, 1999 (JP) ..... 11-070520
Aug. 4, 1999 (JP) ..... 11-221314

(51) Int. Cl.[7] ..... H01R 9/05
(52) U.S. Cl. ..... 439/582
(58) Field of Search ..... 439/582, 610, 439/902

(56) References Cited

U.S. PATENT DOCUMENTS 3,432,798 * 3/1969 Brishka ..... 439/582

* cited by examiner

*Primary Examiner*—Brian Sircus
*Assistant Examiner*—Javaid Nasri
(74) *Attorney, Agent, or Firm*—Wenderoth, Lind & Ponack, L.L.P.

(57) ABSTRACT

The present invention provides an L-shaped connector for connecting an antenna wire to an image or acoustic equipment. The antenna wire has a coaxial core wire, a shield cover and primary and secondary insulation coating materials. The L-shaped connector comprises a metallic body case having a horizontal portion, a vertical portion and at least one leg portion. A metallic tip end side cylindrical case is fitted to the horizontal portion of the metallic body case. A plug pin support is made of insulation material and is attached within the horizontal portion of the metallic body case. A metallic plug pin is horizontally inserted into and attached to the plug pin support. And, a cylindrical protective case is comprised of a pair of cylindrical halves, made of insulation material, and housed in the vertical portion of the metallic body case, wherein at least the core wire of the antenna wire is passed through the cylindrical protective case to be electrically connected to the plug pin and the cylindrical protective case is held within the metallic body case by bending the at least one leg portion.

20 Claims, 8 Drawing Sheets

L-SHAPED CONNECTOR FOR CONNECTING ANTENNA WIRE

BACKGROUND OF THE INVENTION

The present invention relates to an L-shaped connector for connecting an antenna wire in which electrical performance can be enhanced by providing a protective case within a body case, and an assembling can be facilitated by forming a plug pin in a substantially L-shape (substantially right angle shape).

Generally, in image or acoustic equipment such as televisions, video tape recorders and stereos, or in electronic equipment such as personal computers, inputting and outputting of a picture signal or a sound signal is effected, for example, by using a cable with an electrical connector of a plug pin type. However, in such electronic equipment, recently, since a band of a signal used has been extended to a high output voltage and high frequency band, great electromagnetic waves generated from the electronic equipment reach the cable to affect a bad influence upon the signal being transmitted by the cable, which may cause inconveniences such as distortion of a video tape recorder signal, distortion of a television image, occurrence in noise in the stereo or malfunction of the personal computer.

Further, particularly in television broadcasting, recently, not only BS broadcasting but also CS broadcasting have been utilized. In the former, electromagnetic frequency is presently 1.2 to 1.8 GHz in analogue (1.8 GHz in digital will be expected in the future), and, in the latter, electromagnetic frequency is presently about 1.9 GHz in analogue. Particularly, also in high frequency in the latter case, in order to avoid an influence of electromagnetic radiation, a connector having higher shielding ability is now requested.

In order to prevent the bad influence of the electromagnetic radiation, there has mainly been used a cable of a so-called coaxial cable type in which not only a central conductive wire for transmitting a signal (referred to as "core wire" hereinafter) is covered by a first insulation material but also the insulation material is further covered by a coaxial shield cover for shielding or cutting the electromagnetic radiation, and the shield cover is covered by a second insulation material.

By the way, in the arrangement of the above-mentioned connector, normally, the core wire of the cable is electrically connected to a plug pin supported by a resin plug pin support, and the cable and the plug pin support are housed in a metallic body case, and an outer surface of the metallic body case is coated with resin by molding.

When the connector is not straight but has an L-shape, the core wire of the cable is formed in the form of the L-shape, i.e., is bent at a substantially right angle at an end thereof, which is in turn electrically connected to the plug pin and the assembly is housed in the metallic body case.

However, in comparison with the case where the straight cable and plug pin support are housed, when the right angled cable and plug pin support are housed, since the metallic body case itself must have a complicated L-shaped structure, after the parts are housed in the body case, there is apt to exist any clearances or voids for undesired communication between an interior and an exterior of the body case.

① Accordingly, when the outer surface of the body case is subsequently covered with resin by molding, a part of the molded resin may enter the body case through the voids to cause electrical bad influences such as deterioration of impedance matching.

② Further, since the body case itself has the complicated L-shaped structure, when the cable is housed within the body case, the body case may be deformed to compress and deform the cable, thereby causing similar electrical bad influences.

③ In addition, in the L-shaped connector, when an operation for bending the core wire of the coaxial cable to the L-shape is effected, since the working space itself is relatively small, the L-shaped bending operation becomes difficult.

SUMMARY OF THE INVENTION

An object of the present invention is to provide an L-shaped connector for connecting an antenna wire in which, since an L-shaped (substantially right angled) electrically connected portion is housed in a cylindrical protective case (6) previously housed in a body case, a part of molded resin on an outer surface of the body case does not enter the cylindrical protective case (6).

Another object of the present invention is to provide an L-shaped connector in which, since an L-shaped bent portion of a cable is previously housed in a cylindrical protective case (6) to be protected, when the cable is housed in a body case, even if the body case is deformed, the cable is not compressed and deformed.

A further object of the present invention is to provide an L-shaped connector in which an assembling can be facilitated by previously forming a plug pin itself into an L-shape and by connecting a straight core wire of a coaxial cable to the L-shaped plug pin as it is.

A still further object of the present invention is to provide an L-shaped connector in which, since a core wire of a coaxial cable is straight, the coaxial cable itself may not be distorted to generate any force for bending the core wire.

To achieve the above objects, according to a first aspect of the present invention, there is provided an L-shaped connector (1) for connecting an antenna wire (7) to an image or acoustic equipment. The L-shaped connector (1) has a coaxial core wire (9), a shield cover (10) and primary and secondary insulation coating materials (11,12). The L-shaped connector (1) comprises a substantially L-shaped metallic body case (2) having a horizontal portion (2*a*), a vertical portion (2*d*) and at least one leg portion (2*e*). A metallic tip end side cylindrical case (3) is fitted to the horizontal portion (2*a*) of the body case (2). A plug pin support (4) is made of insulation material and is attached within the horizontal portion (2*a*) of the body case (2). A metallic plug pin (5) is horizontally inserted into and attached to the plug pin support (4). And, a cylindrical protective case (6) is comprised of a pair of cylindrical halves (6A, 6B), made of insulation material, and is housed in the vertical portion (2*d*) of the body case (2). At least the core wire (9) of the antenna wire (7) is vertically passed through the cylindrical protective case (6) to be electrically connected to the plug pin (5), and the cylindrical protective case (6) is held within the body case (2) by bending the at least one leg portion (2*e*) of the body case.

Preferably, at least an upper surface portion and side surface portions of the cylindrical protective case (6) are closely fitted within the interior of the body case (2) so that there is no void or clearance for communicating between the exterior of the body case (2) and the interior of the protective case (6).

Preferably, an upper end (11*a*) of at least the primary insulation coating material (11) of the coaxial cable or antenna wire (7) is housed in the protective case (6).

Preferably, the at least one leg portion (2*e*) is bent along the circumference of the protective case (6) through a predetermined distance (m) in a vertical direction at a lower end of the protective case (6).

Preferably, the pair of cylindrical halves (6A, 6B) of the protective case (6) are molded from ABS resin.

Preferably, the plug pin (5) has a cylindrical engagement portion (5*b*) at its one end, and the plug pin (5) and the core wire (9) are engaged to each other to be electrically interconnected by caulking the engagement portion (5*b*) when a tip end portion of the core wire (9) is inserted into the cylindrical engagement portion (5*b*).

Preferably, at least one (6A) of the pair of cylindrical halves (6A, 6B) of the protective case (6) has a through hole (6*d*) at its predetermined position, and a substantially right-angled bent end portion (9*a*) of the core wire (9) is engaged by the engagement portion (5*b*) of the plug pin (5) through the through hole (6*d*) to be electrically interconnected.

Preferably, the other (6B) of the pair of cylindrical halves (6A, 6B) of the protective case (6) has a support portion (6C1) for abutting against the bent portion (9*a*) of the core wire (9) to support the latter.

According to a second aspect of the present invention, there is provided an L-shaped connector (21) for connecting an antenna wire (27) to an image or acoustic equipment. The L-shaped connector (21) has a coaxial core wire (29), a shield cover (30) and primary and secondary insulation coating materials (31, 32). The L-shaped connector (21) comprises a metallic body case (22) having a substantially cylindrical horizontal portion (22*a*) and at least one substantially cylindrical leg portion (22*e*). A metallic tip end side cylindrical case (23) is fitted to the horizontal portion (22*a*) of the body case (22). A plug pin support (24) is made of insulation material and is attached within the horizontal portion (22*a*) of the body case (22). And, a substantially L-shaped metallic plug pin (25) has a body portion (25*a*) provided at its one end with a tip end pin portion (25*b*) to be horizontally inserted into the plug pin support (24), and provided at its other end with a core wire connecting portion (25*c*) to be connected to the core wire (29) of the antenna wire (27).

Preferably, the at least one cylindrical leg portion (22*e*) is closely wound around the circumference of the core wire (29) and is closely contacted with the circumference of the body case (22) or the tip end side case (23).

Further, preferably, a semi-circular notch (23*e*) is formed in a portion of the tip end side case (23) near the body case (22), and, when the at least one cylindrical leg portion (22*e*) is closely wound around the circumference of the core wire (29), the at least one leg portion is closely contacted with the circumference of the tip end side case (23) along the periphery of the semi-circular notch (23*e*).

Preferably, the core wire connecting portion (25*c*) of the plug pin (25) is a cylindrical engagement portion (25*c*) provided at the other end of the body portion (25*a*), and the plug pin (25) and the core wire (29) are engaged with each other to be electrically interconnected by caulking the engagement portion (25*c*) when a tip end portion of the core wire (29) is inserted into the cylindrical engagement portion (25*c*).

According to the first aspect of the present invention, the following effects can be achieved:

① Since the L-shaped (substantially right angled) electrically connected portion is housed in the cylindrical protective case (6) previously housed in the body case (2), a part of molded resin on the outer surface of the body case does not enter the body case (2) or the cylindrical protective case (6).

② Further, since at least the primary coating material (11) of the coaxial cable is previously housed in the cylindrical protective case (6) to be protected, when the cable is housed in the body case, even if the body case is deformed, the cable is not compressed and deformed.

③ Further, when the at least one leg portion (2*e*) of the body case (2) is bent, it is bent along the outer peripheral surface of the cylindrical protective case (6), and the secondary coating material (12) is not compressed and deformed.

According to the second aspect of the present invention, the following effects can be achieved:

④ Since the plug pin (25) itself is previously formed in the form of a L-shape (right-angled shape), the core wire (29) of the coaxial cable (27) can be connected to the L-shaped plug pin while keeping the straight condition as it is, thereby facilitating the assembling operation. In addition, since the L-shape forming (right-angle bending) of the plug pin (25) is performed by a press, the forming or bending operation is easy, thereby capable of reducing the manufacturing cost.

⑤ Further, since the core wire of the coaxial cable is kept in the straight condition, the coaxial cable itself may be distorted by any force for bending the core wire.

DETAILED DESCRIPTION OF THE INVENTION

Figure 1:
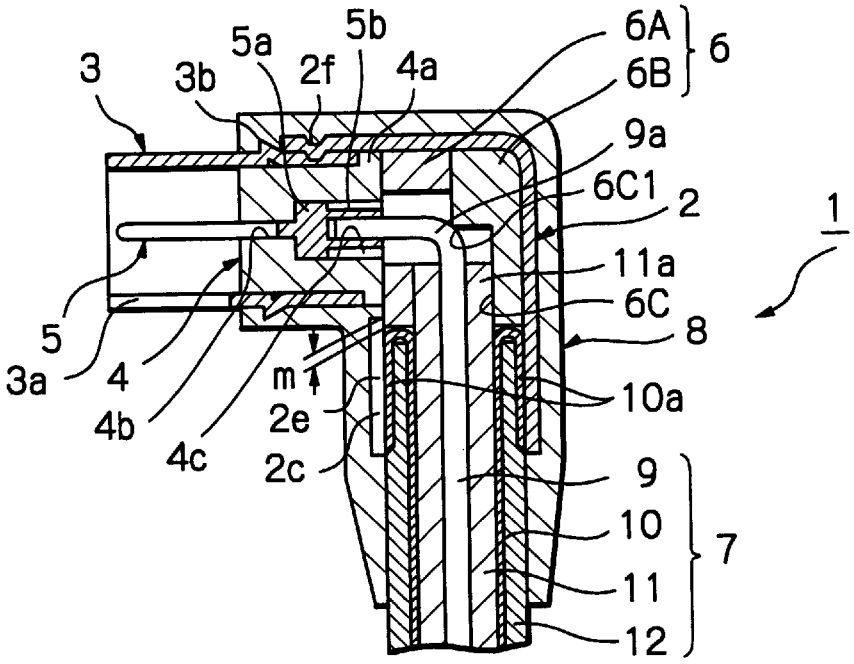
FIG. 1 is a longitudinal sectional view of an L-shaped connector for connecting an antenna wire according to an embodiment of the present invention.

In FIG. 1 a coaxial cable 7 is attached to an L-shaped connector 1. The L-shaped connector 1 comprises a L-shaped metallic (for example, bronze phosphate, brass or iron) body case 2, a metallic (for example, bronze phosphate) tip end side cylindrical case 3, a cylindrical resin (for example, Teflon) plug pin support 4, a metallic (for example, bronze phosphate) plug pin 5, and a resin protective case 6 having a pair of insulation material (for example, ABS resin) cylindrical halves 6A, 6B. The coaxial cable 7 comprises a core wire 9, a shield cover 10 and a pair of insulation coating materials 11, 12 connected to the L-shaped connector 1. Incidentally, since bronze phosphate has excellent conductivity superior to that of iron, and also has excellent spring or resilient properties and strength superior to that of brass, it is preferable that bronze phosphate is used as the material for the members (such as the tip end side cylindrical case 3 and the plug pin 5), which are to be electrically mated with each other.

An insulation resin cover 8 is integrally molded to cover or coat an assembly of the L-shaped connector 1 and the coaxial cable 7.

Figure 2:
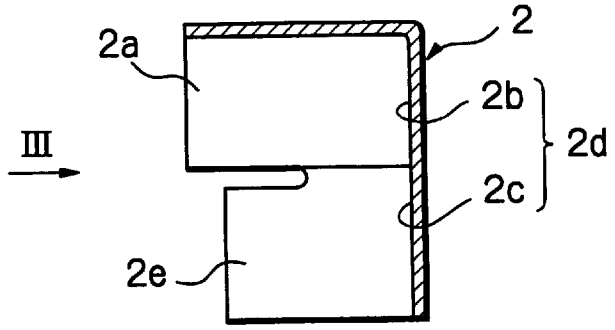
FIG. 2 is a longitudinal sectional side view of a body case of the connector of FIG. 1.
Figure 3:
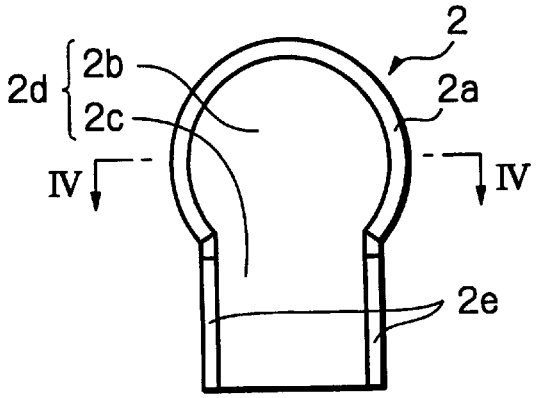
FIG. 3 is a view of the body case, looked at from a direction shown by the arrow III in FIG. 2.
Figure 4:
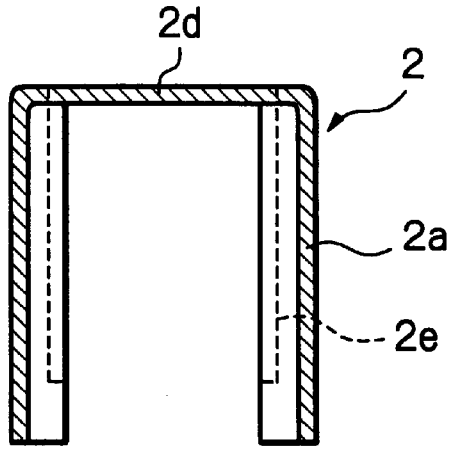
FIG. 4 is a sectional view of the body case taken along the line IV—IV in FIG. 3.

As shown in FIGS. 2 to 4, the L-shaped body case 2 comprises a cylindrical horizontal portion 2*a* having an axis extending in a horizontal direction, and a vertical portion 2*d* having a flat plate-shaped circular bottom 2*b* and a portion 2*c* (having a pair of leg portions 2*e*) having a substantially U-shaped cross-section. Incidentally, as shown in FIG. 3, a lower portion of the cylindrical horizontal portion 2*a* is removed in a range of an angle of about 110 degrees. Further, in the specification, "horizontal direction" and "vertical direction" correspond to a lateral direction and an up-and-down direction in the drawings, respectively, and do not mean specific direction with respect to perpendicularity.

Figure 5:
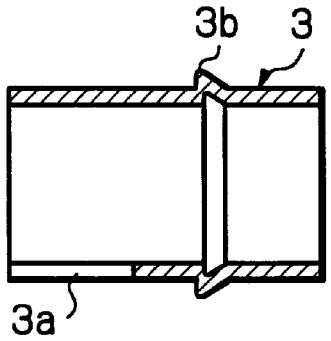
FIG. 5 is a longitudinal sectional side view of a tip end side cylindrical case of the connector of FIG. 1.

As shown in FIG. 5, the tip end side cylindrical case 3 is provided with a narrow axial slit 3*a* and an enlarged diameter portion 3*b* located at a predetermined axial position. When the cylindrical case 3 is fitted into a female hole (not shown) of a corresponding socket of the L-shaped connector 1, the slit 3*a* permits circumferential contraction or expansion deformation of the case 3 due to the fitting dimension error. Further, the enlarged diameter portion 3*b* is penetrated into the insulation resin cover 8 (which will be molded later) to prevent the case 3 itself from dislodging from the cover 8.

Figure 6:
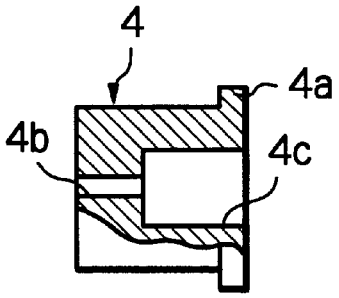
FIG. 6 is a side view, in partial section, of a plug pin support of the connector of FIG. 1.

As shown in FIG. 6, the cylindrical resin plug pin support 4 has a flange 4*a*, a central through small diameter bore 4*b* and a large diameter bore 4*c*.

Figure 7:
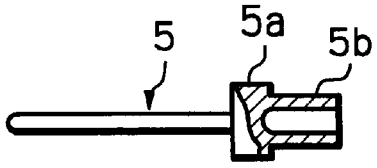
FIG. 7 is a side view, in partial section, of a plug pin of the connector of FIG. 1.
Figure 8:
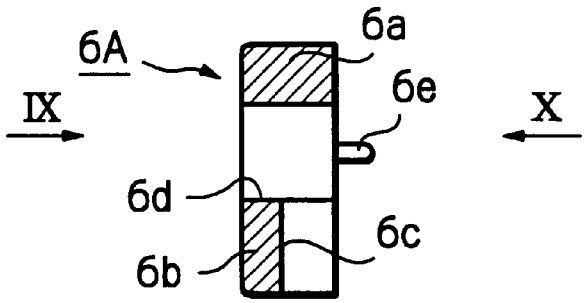
FIG. 8 is a longitudinal sectional side view of a cylindrical half of a protective case of the connector of FIG. 1.
Figure 9:
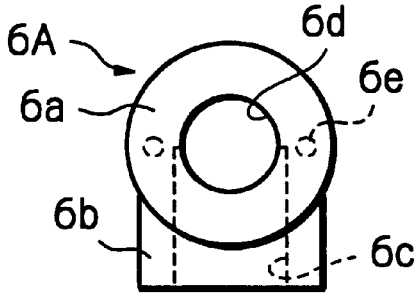
FIG. 9 is a view of the cylindrical half, looked at from a direction shown by the arrow IX in FIG. 8.
Figure 10:
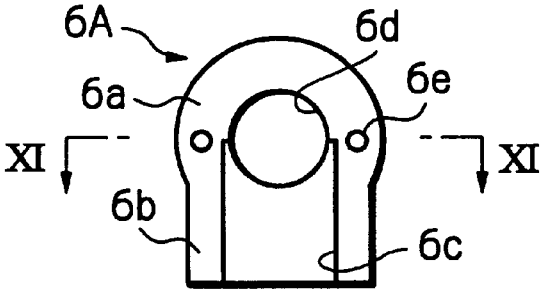
FIG. 10 is a view of the cylindrical half, looked at from a direction shown by the arrow X in FIG. 8.
Figure 11:
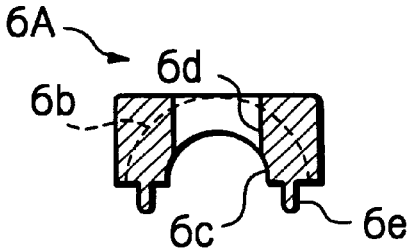
FIG. 11 is a sectional view taken along the line XI—XI in FIG. 10.
Figure 12:
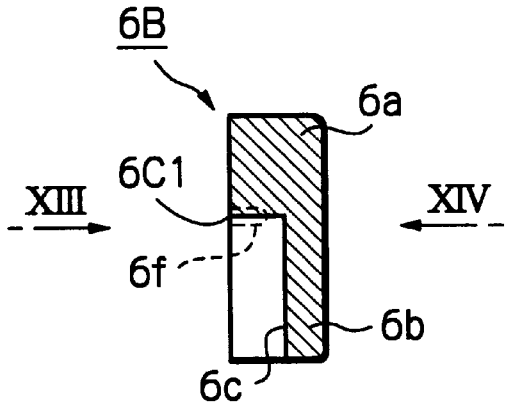
FIG. 12 is a longitudinal sectional side view of the other cylindrical half of the protective case of the connector of FIG. 1.
Figure 13:
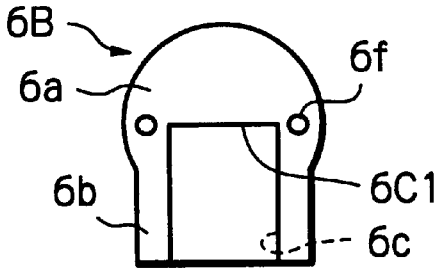
FIG. 13 is a view of the other cylindrical half, looked at from a direction shown by the arrow XIII in FIG. 12.
Figure 14:
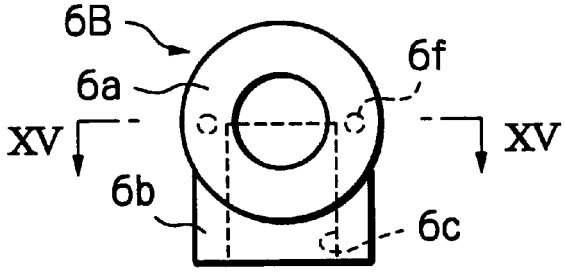
FIG. 14 is a view of the other cylindrical half, looked at from a direction shown by the arrow XIV in FIG. 12.
Figure 15:
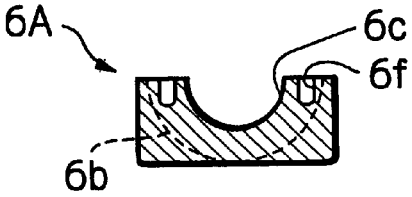
FIG. 15 is a sectional view taken along the line XV—XV in FIG. 14.

As shown in FIG. 7. the plug pin 5 Is provided at its right end with a flange 5*a* and a cylindrical engagement portion 5*b*.

As shown in FIGS. 8 to 11, the left cylindrical half 6A is constituted byjoining a circular plate portion 6*a* having an axis extending substantially in a horizontal direction to a semi-circular cylindrical portion 6*b* having an axis extending substantially in a vertical direction and having a semi-circular cross-section. The cylindrical half 6A has a hole 6*c* formed in an inner surface thereof, which hole 6*c* has an axis extending in the vertical direction and also has a semi-circular cross-section. The cylindrical half 6A also has a central through window hole 6*d* formed in the circular plate portion 6*a*, and two engagement projections 6*e* split along the horizontal direction.

On the other hand, as shown in FIGS. 12 to 15, the right cylindrical half 6B has a substantially similar shape to that of the cylindrical half 6A, and the similar parts will be designated by the same reference numerals. In the right cylindrical half 6B, a through hole such as the through hole 6*d* of the cylindrical half 6A is not provided, and, in place of the engagement projections 6*e*, two engagement recesses 6*f* to be engaged by the engagement projections are provided.

Next, an assembling procedure of the L-shaped connector 1 will be explained.

First of all, the coaxial cable 7 is prepared, and, as shown in FIG. 1, the primary coating material 11 and the secondary coating material 12 are successively removed by predetermined distances from the tip ends, and the shield cover 10 is turned over or folded back, thereby forming a primary coating material protruded portion lha and a shield cover fold-back portion 10*a*. Then, after the protruded core wire 9 is inserted into the cylindrical engagement portion 5*b* of the plug pin 5 (which is not yet attached to the plug pin support 4), the engagement portion 5*b* is caulked to be engaged by the core wire.

Then, as shown in FIG. 1, the plug pin 5 is passed through the bores 4*c*, 4*b* of the plug pin support 4 until the flange 5*a* abuts against the bottom of the bore 4*c*, thereby protruding the pin 5 leftwards Thereafter, as shown in FIG. 1, the assembly 7, 5, 4 is attached to the split protective case 6 in such conditions that the protruded core wire 9 is bent substantially at a right angle and that the primary coating material protruded portion 11*a* is fitted in the hole 6*c* of the protective case 6 and the upper end of the shield cover fold-back portion 10*a* abuts against the lower end of the protective case 6 and that the flange 4*a* of the plug pin support 4 abuts against the cylindrical half 6A.

At the same time, the engagement projections 6*e* of the cylindrical half 6A is fitted into the engagement recesses 6*f* of the cylindrical half 6B, thereby completing the protective case 6.

Then, as shown in FIG. 1, the tip end side cylindrical case 3 is fitted into the plug pin support 4 until it abuts against the flange 4*a*. Thereafter, as shown in FIG. 1, a portion of the body case 2 near at its tip end is subjected to punching at one or two locations to form punch-deformed portion(s) 2*f*, with the result that the cases 2, 3 are deformed, thereby preventing relative rotation therebetween.

As shown in FIG. 1, the assembly 7, 5, 4, 6, 3 obtained in this way is assembled to the L-shaped body case 2 in such a manner that the circular plate portion 6*a* of the protective case 6 is fitted into the cylindrical horizontal portion 2*a* along the axial direction and the cylindrical portion 6*b* is fitted into the U-shaped portion 2*c* so that the portions 6*a*, 6*c* commonly abut against the vertical portion 2*d* (2*b*,2*c*). Accordingly, at least the upper surface portion and side surface portion (extending through about 180 degrees) of the cylindrical protective case 6 is relatively closely fitted into the body case 2 so that any void or clearance for communicating the interior of the protective case 6 with the exterior of the body case 2 is not created. Further, the lower end portion of the protective case 6 is overlapped with the upper end portions of the leg portions 2*e* by the amount m as shown in FIG. 1 in the vertical direction so that the communication between the interior and the exterior of the body case 2 is prevented.

Then, the pair of leg portions 2*e* are bent inwardly to be engaged by the cylindrical portion 6*b* of the protective case 6. In this case, as shown in FIG. 1, the shield cover fold-back portion 10*a* of the secondary insulation material 12 is pinched between the U-shaped portion 2*c* (or pair of leg portions 2*e*) and the outer surface of the secondary insulation material 12 and thus is electrically connected to the body case 2. Incidentally, in FIG. 1, the upper end of the secondary insulation material 12 is shown as a narrower portion.

Lastly, as shown in FIG. 1, the resin insulation resin cover 8 is molded on the outer surface of the entire assembly.

In this case, a corner support portion 6C1 of the semicircular hole 6*c* of the cylindrical half 6B substantially abuts against the right-angled bent portion of the core wire 9 to support the plug pin 5 if the plug pin is pushed accidentally to the right in FIG. 1.

In this case, as mentioned above, since there is no void for communication between the interior and the exterior of the body case 2, the fact that the molded resin enters the interior of the body case 2 or the protective case 6 to affect a bad influence upon the electrical property can be avoided.

Further, since the primary coating material protruded portion 11*a* of the cable 7 is housed within the protective case 6 to be protected mechanically, the flexible primary coating material 11 is not compressed and deformed, and, since the leg portions 2*e* are bent around the overlapped (by the dimension m) of the protective case 6, the upper end of the flexible secondary coating material 12 is not compressed and deformed, and, therefore, the electrical bad influence can be further avoided. Incidentally, the overlapped dimension m can be changed appropriately. When the dimension m is great, the winding and bending operation of the leg portions 2*e* around the protective case 6 can be facilitated to further suppress compression deformation of the upper end of the secondary coating material 12.

Next, another embodiment of the present invention will be explained.

Figure 16:
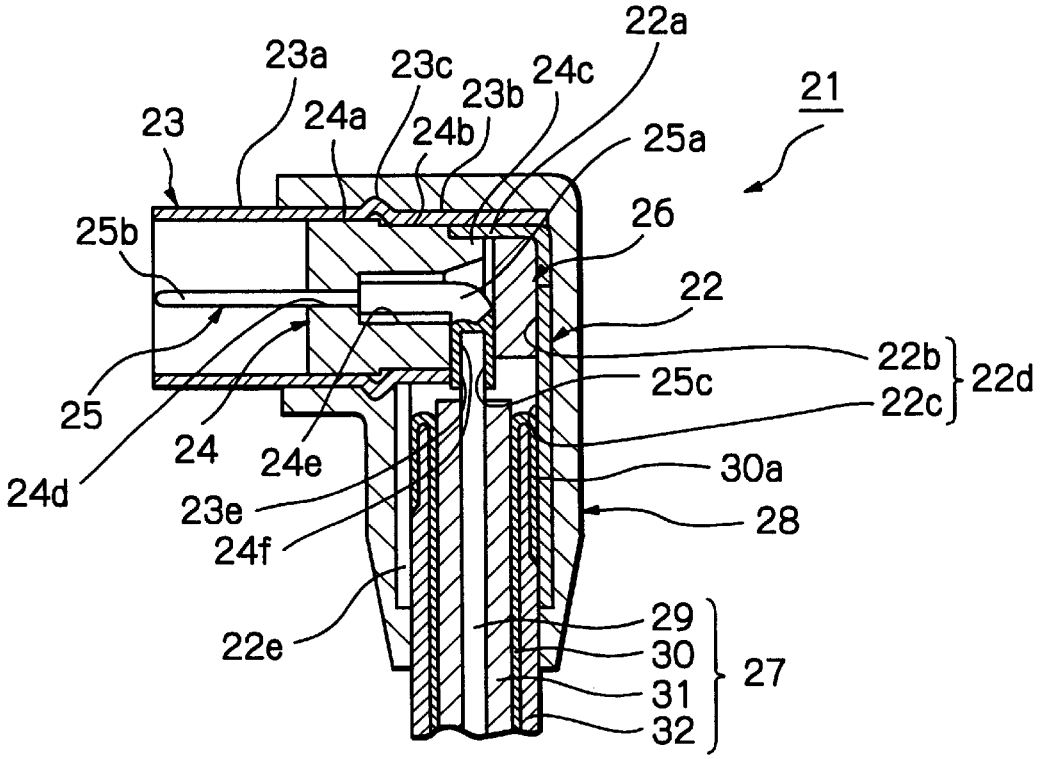
FIG. 16 is a longitudinal sectional view of L-shaped connector for connecting an antenna wire according to another embodiment of the present invention.

In FIG. 16, a coaxial cable 27 is attached to the L-shaped connector 21.

The L-shaped connector 21 comprises a metallic (for example, bronze phosphate, brass or iron) body case 22, a metallic (for example, bronze phosphate) tip end side cylindrical case 23, a cylindrical insulation material (for example, ABS resin) plug pin support 24, a metallic (for example, bronze phosphate) plug pin 25, and a disc-shaped resin (for example, ABS) plug pin hold-down member 26. The coaxial cable 27 comprises a core wire 29, a shield cover 30 and a pair of insulation coating materials 31, 32 connected to the L-shaped connector. And, an insulation resin cover 28 is integrally molded to cover or coat an assembly of the L-shaped connector and the coaxial cable.

Figure 17:
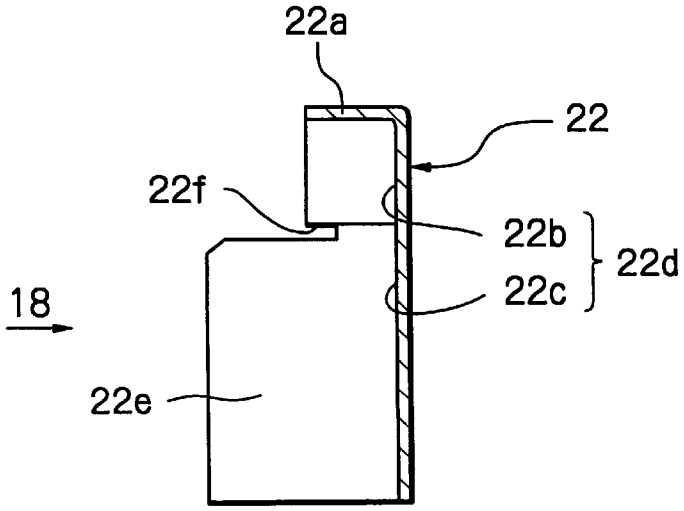
FIG. 17 is a longitudinal sectional side view of a body case of the connector of FIG. 16.
Figure 18:
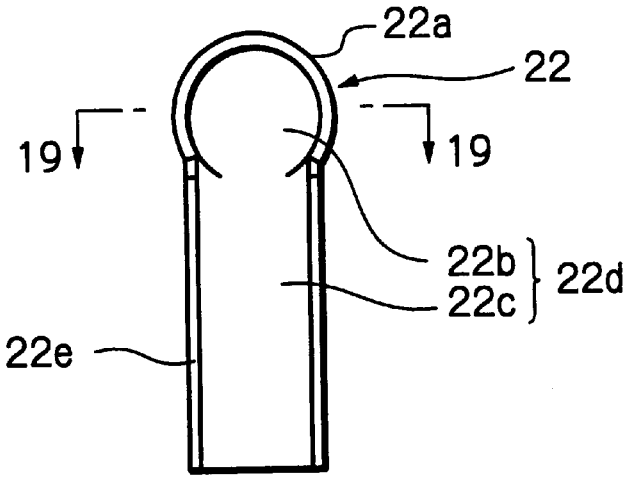
FIG. 18 is a view of the body case, looked at from a direction shown by the arrow 18 in FIG. 17.
Figure 19:
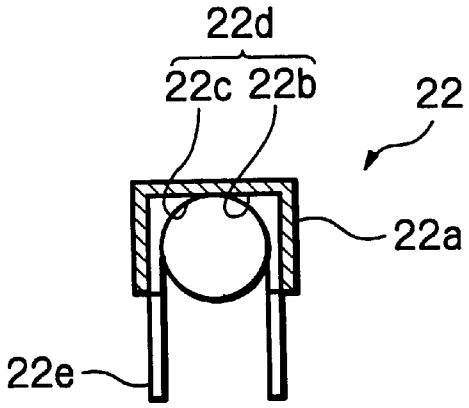
FIG. 19 is a sectional view of the body case taken along the line 19—19 in FIG. 18.

As shown in FIGS. 17 to 19, the body case 22 comprises a cylindrical horizontal portion 22*a* having an axis extending substantially in a horizontal direction, and a vertical portion 22*d* having a flat plate-shaped circular bottom 22*b* and a portion 22*c* (having a pair of leg portions 22*e*) having a substantially U-shaped cross-section and having an axis extending in a vertical direction. Incidentally, an axial length of the horizontal portion 22*a* according to this embodiment is longer than that of the horizontal portion 2*a* according to the previous embodiment, and vertical lengths of the leg portions 22*e* according to this embodiment are longer than those of the leg portions 2*e* according to the previous embodiment.

Figure 20:
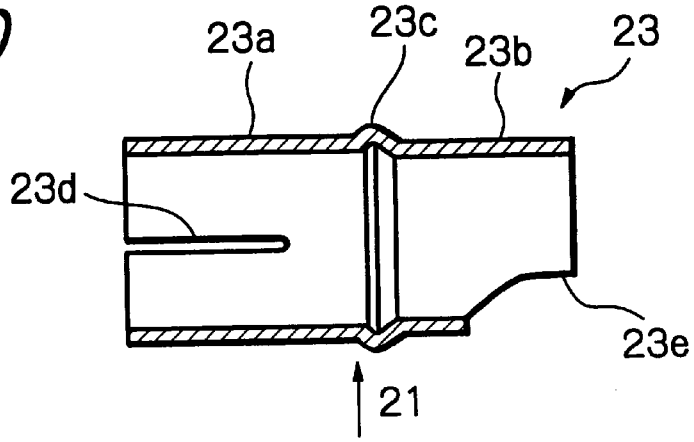
FIG. 20 is a longitudinal sectional side view of a tip end side cylindrical case of the connector of FIG. 16.
Figure 21:
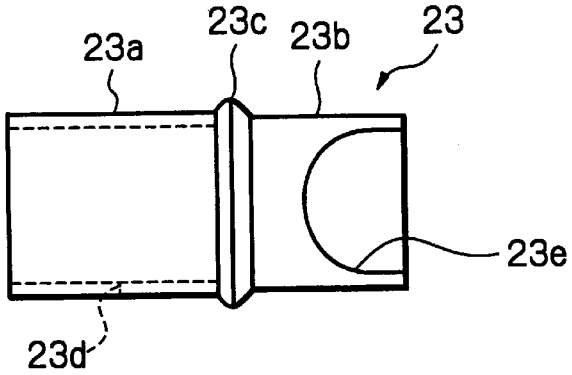
FIG. 21 is a view of the tip end side cylindrical case, looked at from a direction shown by the arrow 21 in FIG. 20.

As shown in FIGS. 20 and 21, the tip end side cylindrical case 23 is provided with a first large diameter cylindrical portion 23*a* and a small diameter cylindrical portion 23*b* with a stepped portion 23*c* there-between. In this case, the large diameter cylindrical portion 23*a* is provided with two circumferential slits 23*d* and the small diameter cylindrical portion 23*b* is provided with a circumferential semi-circular notch 23*e*. The function of the slits 23*d* is the same as that of the slit in the previous embodiment.

Figure 22:
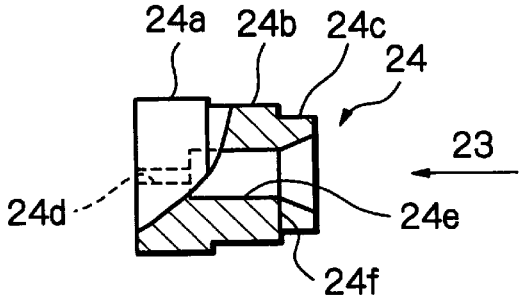
FIG. 22 is a side view, in partial section, of a plug pin support of the connector of FIG. 16.
Figure 23:
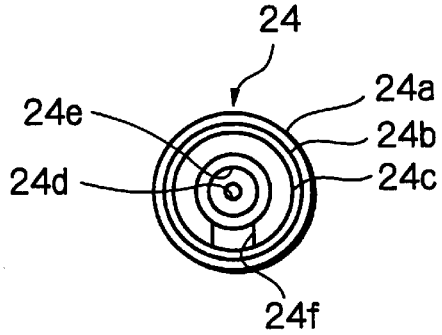
FIG. 23 is a view of the plug pin support, looked at from a direction shown by the arrow 23 in FIG. 22.

As shown in FIGS. 22 and 23, the cylindrical resin plug pin support 24 has a first large diameter portion 24*a*, a second intermediate diameter portion 24*b*, a third small diameter portion 24*c*, a central small diameter through bore 24*d*, a central large diameter through bore 24*e*, and a radial engagement groove 24*f* located at one position in a circumferential direction.

Figure 24:
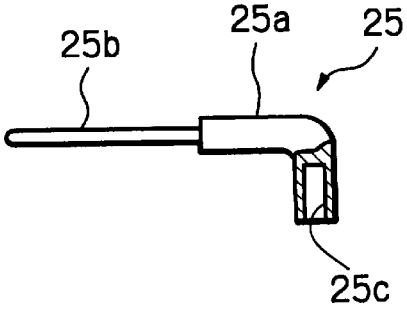
FIG. 24 is a side view, in partial section, of a plug pin of the connector of FIG. 16.
Figure 25:
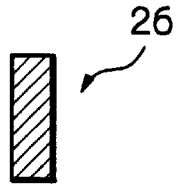
FIG. 25 is a longitudinal sectional side view of a plug pin hold-down member of the connector of FIG. 16.
Figure 26:
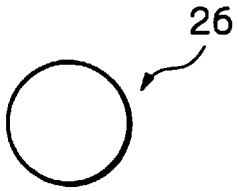
FIG. 26 is a front view of the plug pin hold-down member of FIG. 25.

As shown in FIG. 24, the plug pin 25 is a member previously formed by virtue of a press machine and has a substantially L-shaped (or right-angled) body portion 25*a* having one end on which a tip end pin portion 25*b* is formed, and the other end in which is formed a cylindrical engagement portion 25*c* of a predetermined depth for connecting to the core wire.

Next, an assembling procedure of the L-shaped connector 21 will be explained.

First of all, the coaxial cable 27 is prepared, and, as shown in FIG. 16, the primary coating material 31 and the secondary coating material 32 are successively removed by predetermined distances from the tip ends, and the shield cover 30 is turned over or folded back, thereby forming a primary coating material protruded portion and a shield cover fold-back portion 30*a*. Then, after the protruded core wire 29 is inserted into the cylindrical engagement portion 25*c* of the plug 25 (which is not yet attached to the plug pin support 24), the engagement portion 25*c* is caulked to be engaged by the core wire.

On the other hand, the plug pin support 24 is fitted into the tip end side cylindrical case 23 from the slit 23*d* until a stepped portion at the right end of the large diameter portion 24*a* abuts against the stepped portion 23*c* of the case 23. In this case, the large diameter portion 24*a* and the intermediate diameter portion 24*b* of the plug pin support 24 are closely fitted into the large diameter portion 23*a* and the small diameter portion 23*b* of the case 23, respectively.

Then, as shown in FIG. 16, the plug pin 25 to which the coaxial cable 27 was attached is inserted into the plug pin support 24 through the large diameter bore 24*e*. And, the tip end pin portion 25*b* of the plug pin 25 is inserted into and engaged by the groove 24*f*. Further, the left end of the L-shaped body portion 25*a* of the plug pin 25 abuts against the bottom of the large diameter bore 24*e*, thereby establishing a condition shown in FIG. 16.

On the other hand, as shown in FIG. 16, the plug pin hold-down member 26 is previously fitted in the cylindrical horizontal portion 22*a* of the body case 22 and is positioned therein.

As shown in FIG. 16, the body case 22 is closely press-fitted into an assembly comprised of the cylindrical case 23, plug pin support 24 and plug pin 25 while inserting the cylindrical horizontal portion 22*a* between the inner peripheral surface of the small diameter cylindrical portion 23*b* of the cylindrical case 23 and the outer peripheral surface of the small diameter portion 24*c* of the plug pin 24, In this case. the positioning between the body case 22 and the case 23 is effected by abutting the bottom of an engagement groove 22*f* of the body case 22 against a predetermined portion of the semicircular notch 23*e* of the case 23. Further, in this case, since the plug pin hold-down member 26 is presses against the vertical portion of the body portion 25*a* of the plug pin 25, the plug pin 25 is not erroneously shifted in the axial direction.

Incidentally, in FIG. 16, although the cylindrical horizontal portion 22*a* of the body case 22 is fitted into the tip end side cylindrical case 23, of course, the horizontal portion 22*a* may be fitted on the outer periphery of the case 23. In such a case, when the pair of leg portions 22*e* (described later) are bent inwardly, upper ends of the pair of leg portions 22*e* will be closely contacted with the outer periphery of the body case 22 rather than the tip end side case 23.

In this condition, as is in the previous embodiment, the tip end side case 23 is subjected to punching at one or two locations to form punch-deformed portion(s) (not shown), thereby preventing relative rotation between the cases 22 and 23.

Then, the pair of leg portions 22*e* are bent inwardly to be engaged by the outer peripheral surface of the coaxial cable 27. In this case, as shown in FIG. 16, the shield cover fold-back portion 30*a* of the secondary insulation material 32 is pinched between the U-shaped portion 22*c* (or pair of leg portions 22*e*) of the body case 22 and the outer surface of the secondary insulation material 32 and thus is electrically connected to the body case 22. Further, in this case, since the upper portions of the pair of leg portions 22*e* are bent to be closely contacted with the periphery of the semicircular notch 23*e* of the case 23, no void communicating between the interior and the exterior of the body case 22 is created at these areas.

Lastly, as shown in FIG. 16, the resin insulation resin cover 28 is molded on the outer surface of the entire assembly.

In this case, as is in the previous embodiment, since there is no void for communication between the interior and the exterior of the body case 22, the fact that the molded resin enters the interior of the body case 22 to affect a bad influence upon the electrical property can be avoided.

According to this embodiment, since the L-shaped portion or right-angled portion is provided on the plug pin 25 rather than the core wire 9 of the coaxial cable 7 as shown in FIG. 1, during the assembling, the core wire 29 can be assembled to the plug pin 25 in a straight condition, and, since the right-angled portion of the plug pin 25 is formed by virtue of a press machine, the assembling operation can be facilitated in comparison with the assembling performed while bending the plug pin 25.

Figure 27:
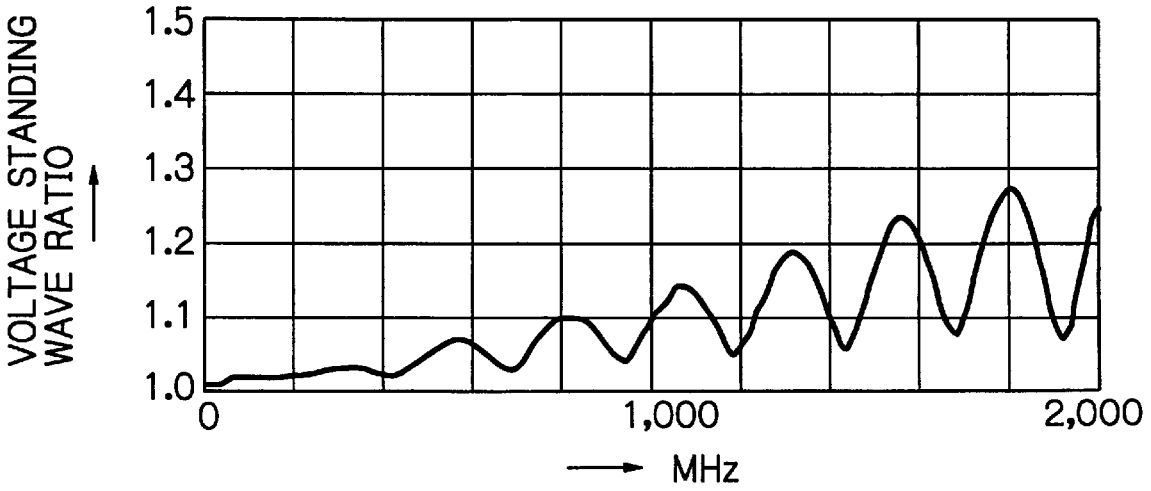
FIG. 27 is a graph showing a result of a performance test of the connector of FIG. 16, where an X-axis indicates change in frequency of a test signal and a Y-axis indicates a voltage standing wave ratio.

FIG. 27 shows a test result of performance of the embodiment of FIG. 16.

In FIG. 27, an X-axis indicates a change of frequency of a test signal and a Y-axis indicates a voltage standing wave ratio. According to the test result shown in FIG. 27, while the frequency of the signal is being increased up to 2,000 MHz (2 GHZ), the voltage standing wave ratio is changed from a minimum value of 1.0 to a maximum value of about 1.27. Generally. in the frequencies of 1 GHz and 2 GHz, voltage standing wave ratios smaller than 1.3 and 1.4 are required. The test result satisfies such requirements, thereby achieving good performance.

What is claimed is:

1. An L-shaped connector for connecting an antenna wire to an image or acoustic equipment, the antenna wire having a coaxial core wire, a shield cover and primary and secondary insulation coating materials, said L-shaped connector comprising:

a substantially L-shaped metallic body case having a horizontal portion, a vertical portion and at least one leg portion;

a metallic tip end side cylindrical case fitted to said horizontal portion of said L-shaped metallic body case;

a plug pin support made of insulation material and attached within said horizontal portion of said L-shaped metallic body case;

a metallic plug pin horizontally inserted into and attached to said plug pin support; and a cylindrical protective case comprised of a pair of cylindrical halves, made of insulation material, and housed in said vertical portion of said L-shaped metallic body case;

wherein at least the coaxial core wire of the antenna wire is vertically passed through said cylindrical protective case to be electrically connected to said metallic plug pin, and said cylindrical protective case is held within said L-shaped metallic body case by bending said at least one leg portion of said L-shaped metallic body case.

2. The L-shaped connector according to claim 1, wherein at least an upper surface portion and said surface portions of said cylindrical protective case are closely fitted within an interior of said L-shaped metallic body case so that there is no space between an interior of said L-shaped metallic case and an exterior of said cylindrical protective case.

3. The L-shaped connector according to claim 2, wherein an upper end of at least the primary insulation coating material of the antenna wire is to be housed in said cylindrical protective case.

4. The L-shaped connector according to claim 2, wherein said at least one leg portion is to be bent along a circumference of said cylindrical protective case through a predetermined distance in a vertical direction at a lower end of said cylindrical protective case.

5. The L-shaped connector according to claim 2, wherein said pair of cylindrical halves of said cylindrical protective case are molded from ABS resin.

6. The L-shaped connector according to claim 1, wherein an upper end of at least the primary insulation coating material of the antenna wire is to be housed in said cylindrical protective case.

7. The L-shaped connector according to claim 6, wherein said at least one leg portion is to be bent along a circumference of said cylindrical protective case through a predetermined distance in a vertical direction at a lower end of said cylindrical protective case.

8. The L-shaped connector according to claim 6, wherein said pair of cylindrical halves of said cylindrical protective case are molded from ABS resin.

9. The L-shaped connector according to claim 1, wherein said at least one leg portion is to be bent along a circumference of said cylindrical protective case through a predetermined distance in a vertical direction at a lower end of said cylindrical protective case.

10. The L-shaped connector according to claim 9, wherein said pair of cylindrical halves of said cylindrical protective case are molded from ABS resin.

11. The L-shaped connector according to claim 1, wherein said pair of cylindrical halves of said cylindrical protective case are molded from ABS resin.

12. The L-shaped connector according to claim 1, wherein said metallic plug pin has a cylindrical engagement portion at one end, and said metallic plug pin and the coaxial core wire are to be engaged with each other to be electrically interconnected by caulking said cylindrical engagement portion when a tip end portion of the coaxial core wire is inserted into said cylindrical engagement portion.

13. The L-shaped connector according to claim 12, wherein at least one of said pair of cylindrical halves of said cylindrical protective case has a through hole at a predetermined position, and a substantially right-angled bent end portion of the coaxial core wire is to be engaged by said cylindrical engagement portion of said plug pin through said through hole to be electrically interconnected.

14. The L-shaped connector according to claim 13, wherein the other of said pair of cylindrical halves of said cylindrical protective case has a support portion for abutting against the bent end portion of the coaxial core wire to support the coaxial core wire.

15. An L-shaped connector for connecting an antenna wire to an image or acoustic equipment, the antenna wire having a coaxial core wire, a shield cover and primary and secondary insulation coating materials, said L-shaped connector comprising:

a metallic body case having at least a substantially cylindrical horizontal portion and at least one substantially cylindrical leg portion;

a metallic tip end side cylindrical case fitted to said substantially cylindrical horizontal portion of said metallic body case;

a plug pin support made of insulation material and attached within said substantially cylindrical horizontal portion of said metallic body case; and a substantially L-shaped metallic plug pin having a body portion provided at one end with a tip end pin portion to be horizontally inserted into said plug pin support, and provided at another end with a cylindrical engagement portion which can be electrically interconnected to the coaxial core wire of the antenna wire by caulking said cylindrical engagement portion when a tip end portion of the coaxial wire is inserted into said cylindrical engagement portion.

16. The L-shaped connector according to claim 15, wherein said at least one substantially cylindrical leg portion is to be closely wound around a circumference of the coaxial wire, and is to be closely contacted with a circumference of said metallic body case or said metallic tip end side cylindrical case.

17. The L-shaped connector according to claim 16, wherein a semi-circular notch is provided at a portion of said metallic tip end cylindrical side case near said metallic body case, and, when said at least one substantially cylindrical leg portion is closely wound around the circumference of the coaxial core wire, said at least one substantially cylindrical leg portion is closely contacted with the circumference of said metallic tip end side cylindrical case along a periphery of said semi-circular notch.

18. An L-shaped connector for connecting an antenna wire to an image or acoustic equipment, the antenna wire having a coaxial core wire, a shield cover and primary and secondary insulation coating materials, said L-shaped connector comprising:

a metallic body case having at least a substantially cylindrical horizontal portion and at least one substantially cylindrical leg portion;

a metallic tip end side cylindrical case fitted to said substantially cylindrical horizontal portion of said metallic body case;

a plug pin support made of insulation material and attached within said substantially cylindrical horizontal portion of said metallic body case; and a substantially L-shaped metallic plug pin having a body portion provided at one end with a tip end pin portion to be horizontally inserted into said plug pin support, and provided at another end with a core wire connecting portion to be connected to the coaxial core wire of the antenna wire, wherein said at least one substantially cylindrical leg portion is to be closely wound around a circumference of the coaxial wire, and is to be closely contacted with a circumference of said metallic body case or said metallic tip end side cylindrical case.

19. The L-shaped connector according to claim 18, wherein a semi-circular notch is provided at a portion of said metallic tip end cylindrical side case near said metallic body case, and, when said at least one substantially cylindrical leg portion is closely wound around the circumference of the coaxial core wire, said at least one substantially cylindrical leg portion is closely contacted with the circumference of said metallic tip end side cylindrical case along a periphery of said semi-circular notch.

20. The L-shaped connector according to claim 18, wherein said core wire connecting portion of said substantially L-shaped metallic plug pin is a cylindrical engagement portion provided at said another end of said body portion, and said substantially L-shaped metallic plug pin and core wire are to be engaged with each other which can be electrically interconnected by caulking said cylindrical engagement portion when a tip end portion of the coaxial core wire is inserted into said cylindrical engagement portion.

* * * * *